US011946721B2

(12) United States Patent
Bray

(10) Patent No.: US 11,946,721 B2
(45) Date of Patent: Apr. 2, 2024

(54) FIREARM STOCK

(71) Applicant: Polaris Capital Corporation, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 331 days.

(21) Appl. No.: 17/581,638

(22) Filed: Jan. 21, 2022

(65) Prior Publication Data

US 2022/0228837 A1 Jul. 21, 2022

Related U.S. Application Data

(60) Provisional application No. 63/140,229, filed on Jan. 21, 2021.

(51) Int. Cl.
*F41C 23/14* (2006.01)

(52) U.S. Cl.
CPC ..... *F41C 23/14* (2013.01)

(58) Field of Classification Search
CPC ..... F41C 23/14; F41C 23/20
See application file for complete search history.

(56) References Cited

U.S. PATENT DOCUMENTS

| | | | | |
|---|---|---|---|---|
| 11,892,267 | B2 * | 2/2024 | Cahill | F41C 23/02 |
| 2018/0347939 | A1 * | 12/2018 | Keller | F41C 23/04 |
| 2019/0137213 | A1 * | 5/2019 | Miller | F41C 23/14 |
| 2021/0239423 | A1 * | 8/2021 | Liptak | F41C 23/12 |

* cited by examiner

*Primary Examiner* — J. Woodrow Eldred
(74) *Attorney, Agent, or Firm* — Kunzler Bean & Adamson

(57) ABSTRACT

Disclosed is an adjustable, sliding stock, and a rifle to which the stock attaches. The stock includes an elongated receiver extension tube coupled to the rifle, and a housing slidably coupled with the receiver extension tube. The housing is positionable at one of a plurality of locking positions that are disposed along a length of the receiver extension tube. The receiver extension tube defines a longitudinal axis along which the housing is positionable. The housing includes a pair of pivoting levers, each of the pair of pivoting levers being disposed on a lateral side of the housing, and where each of the pivoting levers is coupled to and actuates one of a pair of locking members. Each of the pair of locking members travels along a common axis into and out of locking engagement with the receiver extension tube, and where the common axis is transverse to the longitudinal axis.

20 Claims, 7 Drawing Sheets

FIREARM STOCK

FIELD

This application claims the benefit of U.S. Provisional Patent Application No. 63/140,229 entitled "FIREARM STOCK" and filed on Jan. 21, 2021, for Ernest R. Bray, which is incorporated herein by reference.

FIELD

This disclosure relates generally to firearms, and more particularly to adjustable stocks for firearms.

BACKGROUND

A gunstock, or stock, is the part of a firearm which provides structural support to a user to allow the user to brace the firearm and aim while holding the firearm against the user's shoulder. One benefit of bracing the firearm against the user's shoulder is to counter muzzle rise by transmitting recoil into the user's body. Stocks generally are either one of two types, a single-piece stock or a multi-piece stock. Multi-piece stocks allow for collapsing (e.g., telescoping) or folding stocks that are more compact for storage, carrying and concealment. However, collapsible stocks typically have a noticeable amount of movement (i.e., rattle) relative to the adapter that connects the stock to the receiver of the firearm.

SUMMARY

An apparatus for a positionable stock is disclosed. A firearm to which the positionable stock attaches is also disclosed. A method that performs the functions of the apparatus is also disclosed. The stock includes an elongated receiver extension tube coupled to the rifle, and a housing slidably coupled with the receiver extension tube. The housing is positionable at one of a plurality of locking positions that are disposed along a length of the receiver extension tube. The receiver extension tube defines a longitudinal axis along which the housing is positionable. The housing includes a pair of pivoting levers, each of the pair of pivoting levers being disposed on a lateral side of the housing, and where each of the pivoting levers is coupled to and actuates one of a pair of locking members. Each of the pair of locking members travels along a common axis into and out of locking engagement with the receiver extension tube, and where the common axis is transverse to the longitudinal axis.

In certain examples, the housing further comprises a first cut-out portion disposed on a first lateral side of the housing and a second cut-out portion disposed on a second lateral side of the housing opposite the first cut-out portion. Each of the first cut-out portion and the second cut-out portion is configured to receive a finger pad of one of the pair of pivoting levers.

In certain examples, the receiver extension tube comprises a protrusion block that extends along the length of the receiver extension tube. The plurality of locking positions comprise pairs of opposing notches formed in the protrusion block. The protrusion block, in certain examples, further comprises a chamfered surface disposed between a side surface of the protrusion block and an inner wall of one of the notches of the pairs of opposing notches.

In certain examples, each of the pair of locking members comprises a protrusion-block-engaging surface that has a stepped cross-sectional profile. Each of the pair of pivoting levers pivots about a pivot pin coupled with the housing. In certain examples, the housing includes a spring configured to bias the locking members into a locking position. The positionable stock is adjustable to alter a length of pull of the rifle.

In certain examples, the rifle is disclosed and configured to couple with the positionable stock. The method includes providing a positionable stock as discussed above, and in greater detail below.

BRIEF DESCRIPTION OF THE DRAWINGS

In order that the advantages of the invention will be readily understood, a more particular description of the invention briefly described above will be rendered by reference to specific examples that are illustrated in the appended drawings. Understanding that these drawings depict only typical examples of the invention and are not therefore to be considered to be limiting of its scope, the invention will be described and explained with additional specificity and detail through the use of the accompanying drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
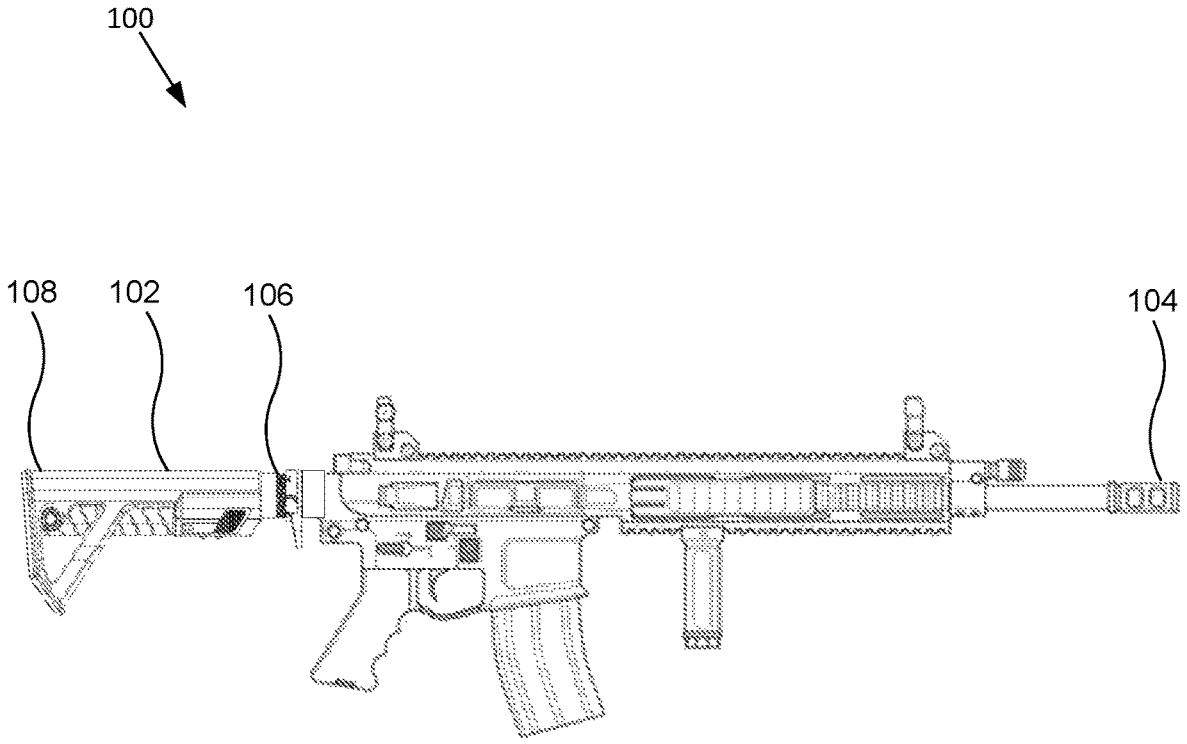
FIG. 1 is a side view diagram illustrating a firearm including an improved stock, in accordance with examples of the present disclosure.

FIG. 1 is a side view diagram illustrating a firearm 100 including an improved stock 102, in accordance with examples of the present disclosure. The stock 102, in the depicted example, may be used with the M16 family of firearms including, but not limited to, all AR variants, the M16 firearm, the M4 firearm, and others that use a bolt carrier. As used herein, the terms "forward" and "front" refer to ends of mechanisms that are nearest the muzzle end 104 of the firearm 100. Similarly, "rear," "rearward," correspond to ends of mechanisms that are furthest from the muzzle end 104 of the firearm.

Accordingly, the stock 102 is formed as an elongated device having a "forward" or first end 106 and a "rearward" or second end 108. The first end 106, when coupled to a receiver extension or buffer tube, is nearest the muzzle end 104 of the firearm 100, and the stock 102 extends axially rearward away from the muzzle end 104. The second end 108 shaped and dimensioned to engage a user (e.g., a shoulder of user) and allow the user to brace the stock 102. However, it is contemplated that the features of the current disclosure are equally applicable to any receiving mechanism of any firearm.

Beneficially, the stock 102 is movable to numerous positions with reference to the firearm 100. In other words, the stock 102 is extendable away from the firearm 100 or collapsible towards the firearm 100. This allows for adjustment of the ergonomics (i.e., the "length of pull") of the firearm based on the size of the user. Additionally, in combat operations, the ability to collapse the stock and make the firearm shorter allows for improved portability and use in close combat situations. Another benefit of the stock 102 of the present disclosure, as will be described in greater detail below, is the near elimination of slop/rattle or relative movement of the stock 102 with reference to the firearm 100.

Figure 2:
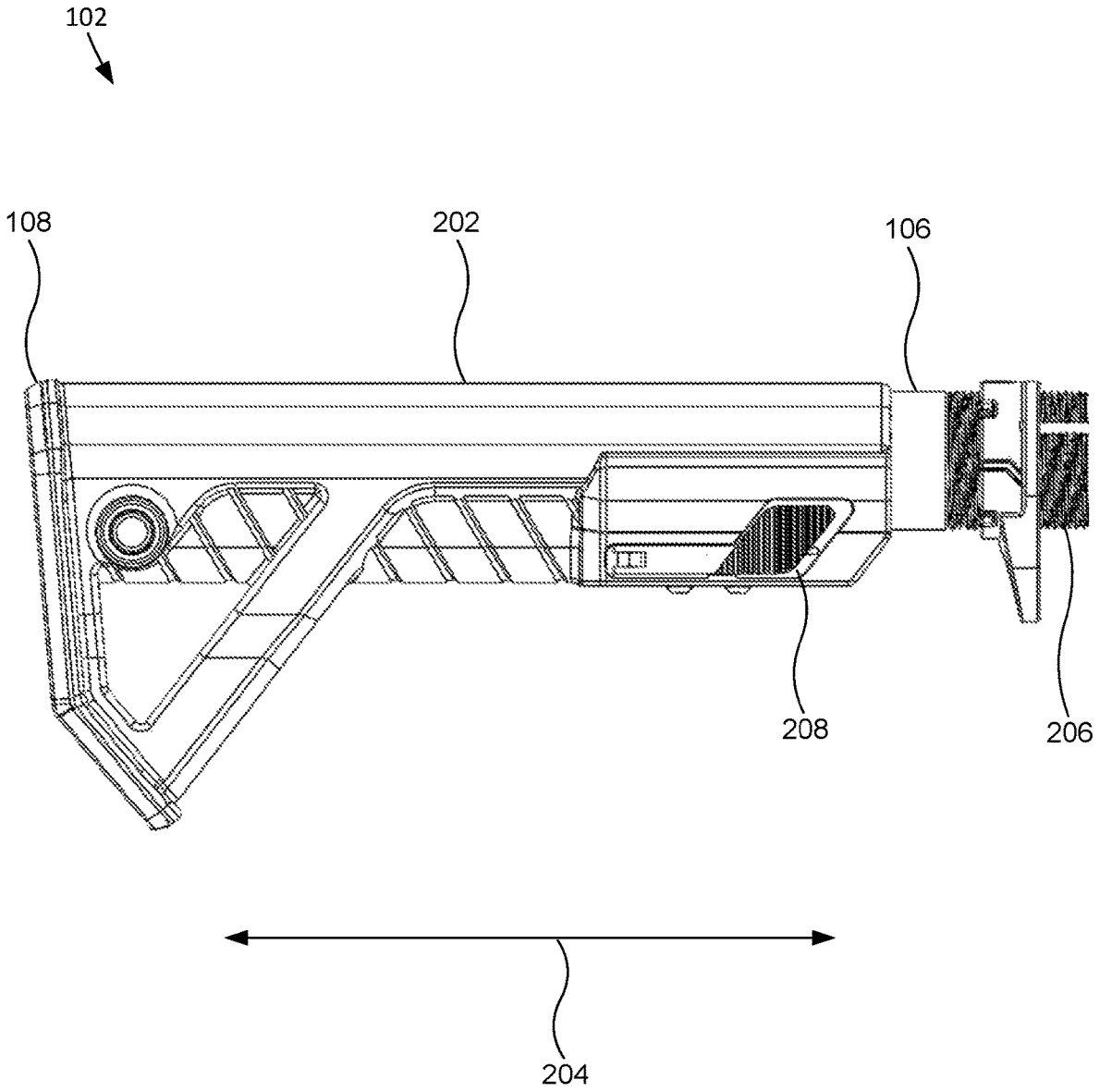
FIG. 2 is a side view diagram of the stock, according to examples of the subject disclosure.

FIG. 2 is a side view diagram of the stock 102, according to examples of the subject disclosure. The stock 102 is formed by a housing 202 configured to extend and retract linearly along an axis 204 that is substantially parallel with an axis of a bore of the firearm 100. The stock 102 is movable to adjust a length of pull of the firearm by moving the housing 202 towards or away from the firearm 100. The housing 202 slidingly couples to a receiver extension tube (or buffer tube) 206 of the firearm 100. The receiver extension tube 206, as known to those skilled in the art, allows a user to attach a stock 102 to the firearm 100. The receiver extension tube 206 also encapsulates the buffer and buffer spring (not shown) to allow a bolt carrier to move axially along the bore axis to eject spent brass and load a next round. Beneficially, the housing 202 of subject disclosure is movable to one of a plurality of lockable positions using a locking mechanism 208.

In certain examples, the locking mechanism 208 is one or more levers disposed on a lateral side of the housing 202. The levers, as will be described in greater detail below, actuate a bar member that engages a recess shaped to receive the bar member. The locking mechanism 208 is releasable to allow the housing 202 to be positioned longitudinally along the axis 204 and adjust the length of pull of the firearm 100. Additional benefits of the stock 102 include substantially reduced (i.e., essentially eliminated) stock wobble.

Figure 3:
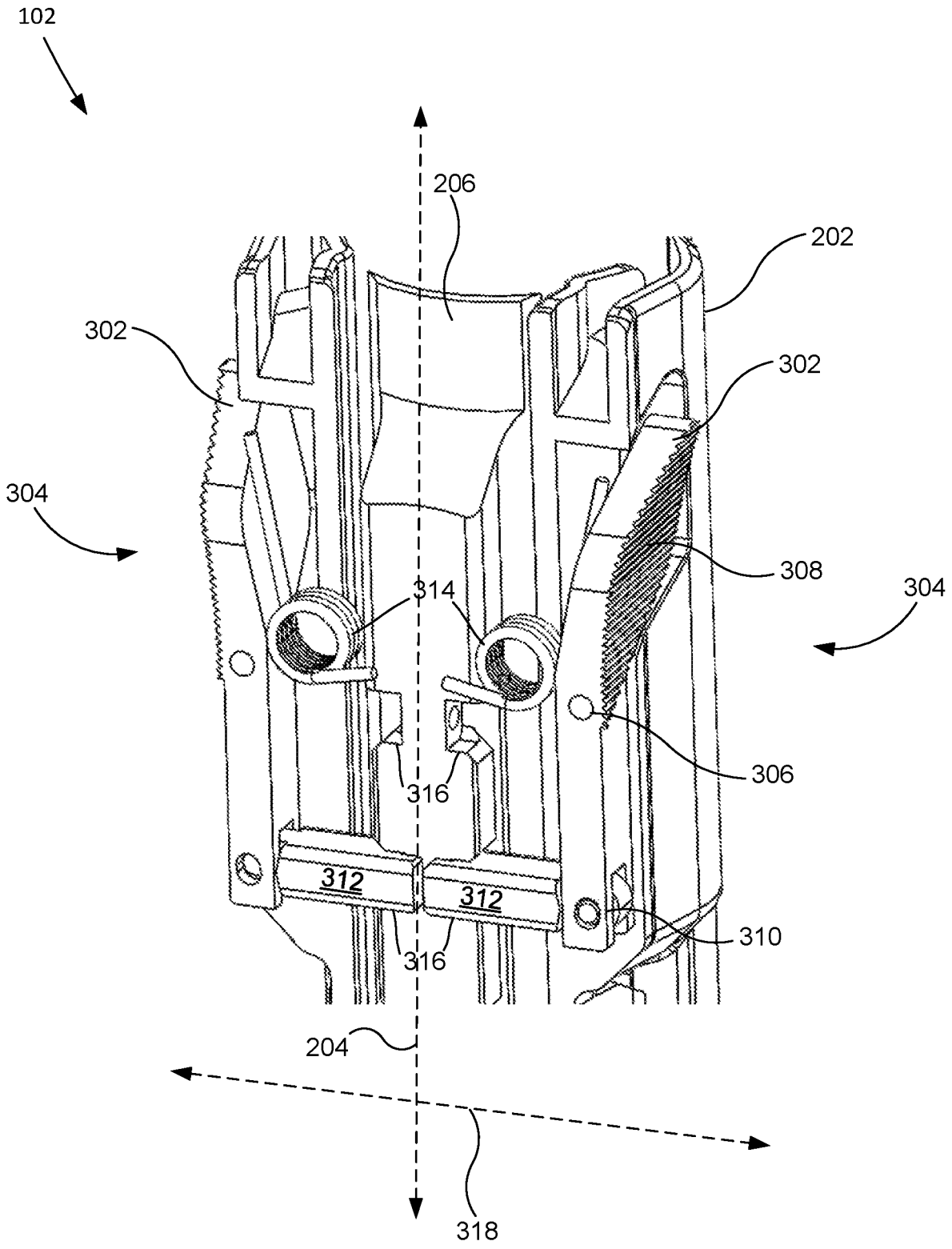
FIG. 3 is a perspective view diagram illustrating a partial view (i.e., certain elements are hidden for clarity) of the housing, according to examples of the subject disclosure.

FIG. 3 is a perspective view diagram illustrating a partial view (i.e., certain elements are hidden for clarity) of the housing 202, according to examples of the subject disclosure. In certain examples, the locking mechanism includes a pair of opposing levers 302. A lever 302 is disposed on each lateral side 304 of the housing 202 and is configured to pivot about a pivot point 306. In certain examples, the pivot point 306 is a pin that is friction fit, or otherwise secured, into the housing 202. Each of the levers 302 has a textured finger pad 308 adjacent a first end, and a linkage coupler 310 adjacent an opposing second end. The linkage coupler 310, in certain examples, engages a locking member 312.

Actuating the finger pad 308 (i.e., depressing the finger pad 308) causes the linkage coupler 310 to retract the locking member 312 from engagement with a locking position 316 of the receiver extension tube 206. Each locking position 316 is formed as notch in a protruding rail of the receiver extension tube 206, in certain examples. A spring 314 is provided and biases the finger pad 308 outward away from the receiver extension tube 206. This biasing urges the locking members 312 towards the receiver extension tube 206 so that when positioned accordingly, the locking members 312 lock into one of the locking positions 316.

In certain examples, the locking members 312 move in and out of locking engagement along an axis 318 that is transverse to the bore axis 204. Furthermore, the pair of opposing locking members 312 move towards each other along the transverse axis 318 when locking into a locking position 316, and away from each other along the transverse axis 318 when disengaging from the locking position 316. The locking members 312 travel within a channel (not shown) of the housing 202 that maintains the orientation of the locking members 312 with respect to the axis 318. The pair of locking members 312 beneficially reduce (and practically eliminate) movement of the stock 102 when locked. Unlike stocks with a single locking pin or member, dual locking members 312 prevent rotational wobble and longitudinal wobble (e.g., along an axis that is parallel to the bore axis 204).

Figure 4:
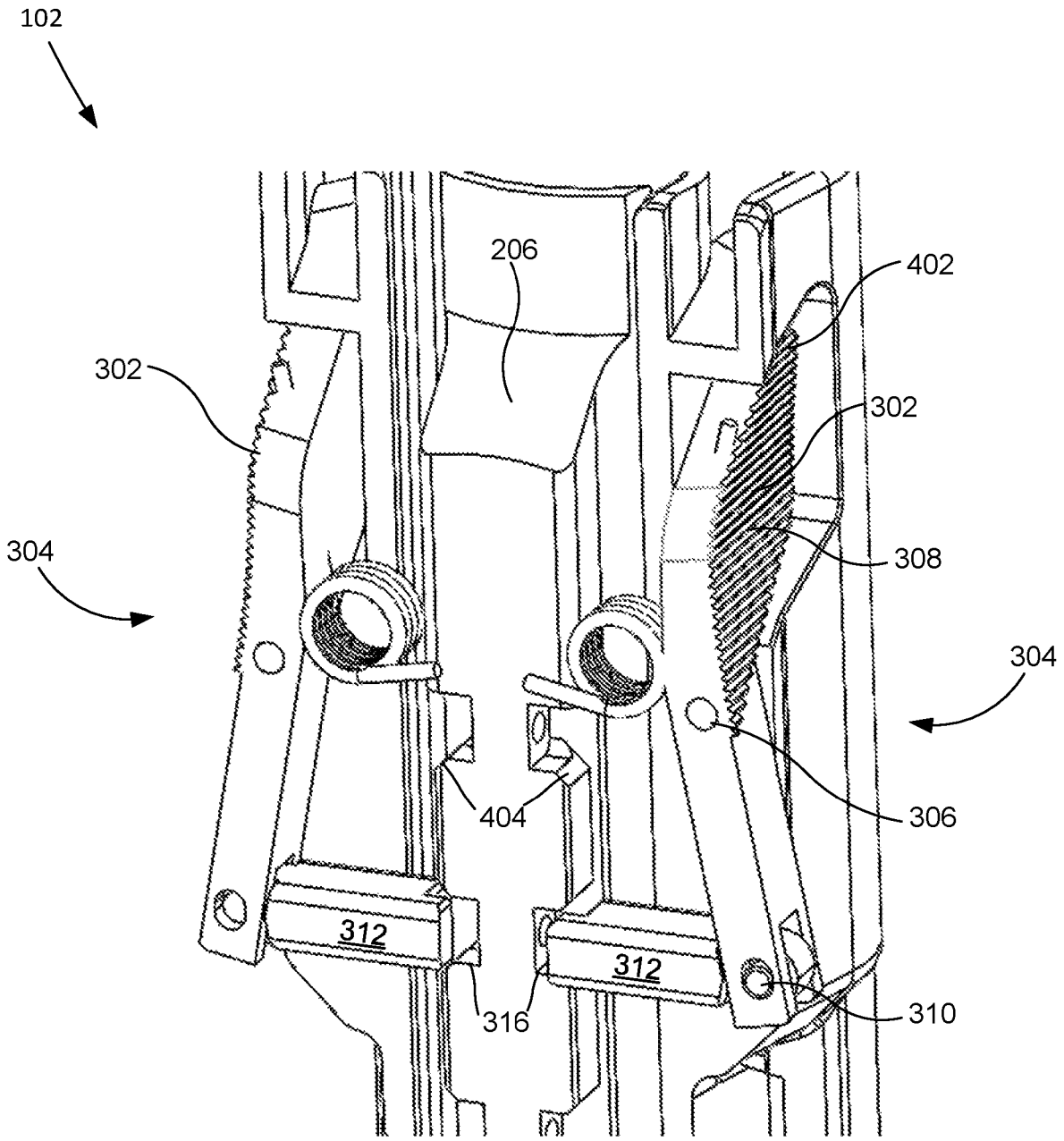
FIG. 4 is a perspective view diagram illustrating an unlocked configuration of the locking mechanism, according to examples of the subject disclosure.

FIG. 4 is a perspective view diagram illustrating an unlocked configuration of the locking mechanism 208, according to examples of the subject disclosure. Unlike FIG. 3, which depicts the locking members 312 in a locked position, the depicted example illustrates depressed or actuated finger pads 308 that in turn retract the locking members 312 from the locking positions 316. A further benefit of the locking mechanism of the subject disclosure is the prevention of accidental actuation of the levers. Depressing both levers 302 simultaneously allows for the repositioning of the stock 102. An accidental actuation of a single lever 302, in certain examples, will not allow for the repositioning of the stock 102.

In certain examples, cut-out portions 402 may be formed in the lateral sides 304 of the stock 102 to allow for the levers 302 to be actuated without requiring that the levers 302 protrude substantially from the lateral sides of the stock 102. In certain examples, the locking positions 316 may be formed with a chamfered face 404 to aide in the seating of the locking member 312, as is described in greater detail below.

Figure 5:
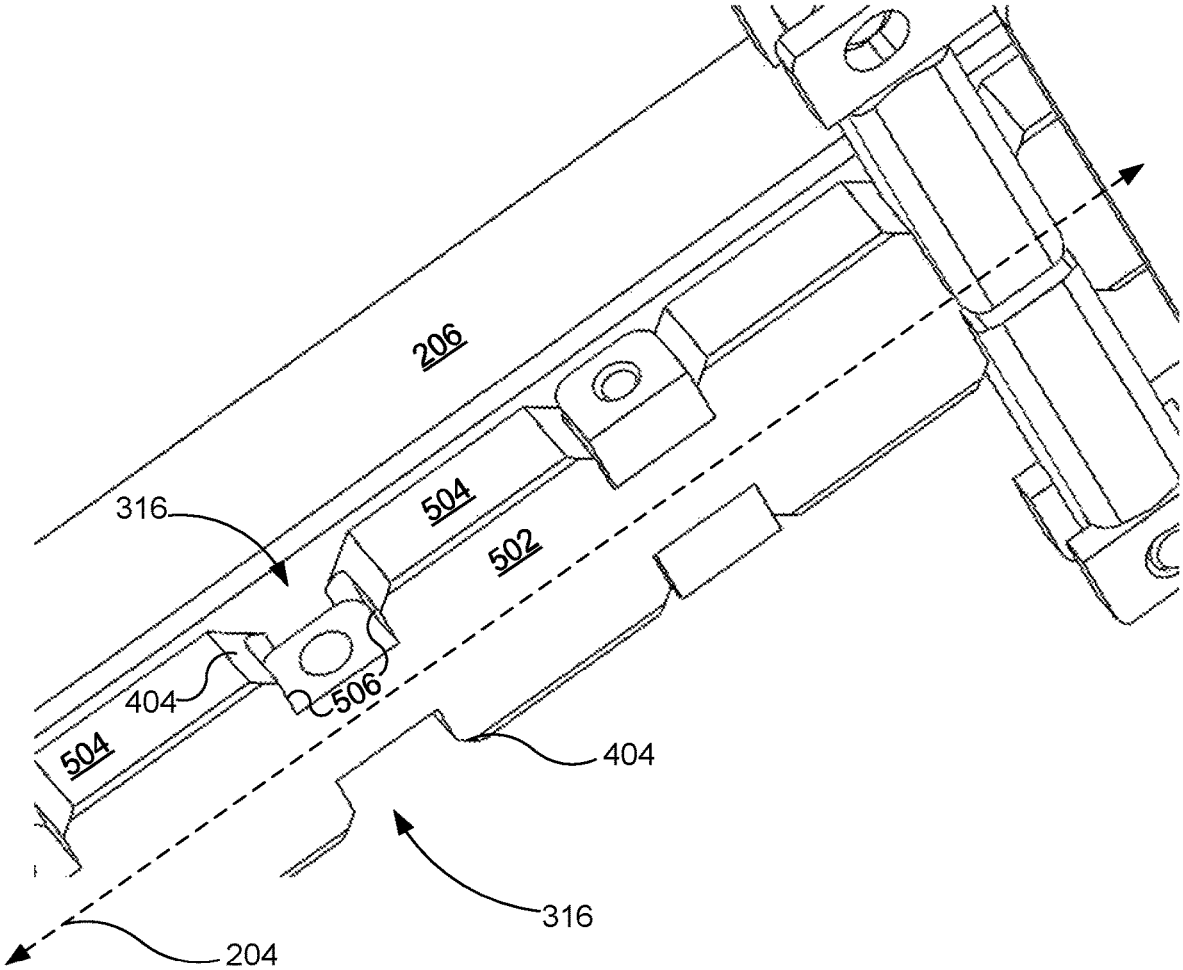
FIG. 5 is a perspective view diagram illustrating an example of the receiver extension tube, according to examples of the subject disclosure.

FIG. 5 is a perspective view diagram illustrating an example of the receiver extension tube 206, according to examples of the subject disclosure. The receiver extension tube 206, in certain examples, includes multiple locking positions 316 for receiving the locking members 312. Each locking position 316, in certain examples, is disposed opposite a corresponding locking position 316 at certain positions along the length of the receiver extension tube 206. The locking positions 316 are formed, in some examples, in a protrusion block 502 that extends from the receiver extension tube 206. The protrusion block 502 may be integrally formed with the receiver extension tube 206. In other examples, the protrusion block 502 is formed separately and fastened to the receiver extension tube 206.

The protrusion block 502 is, in certain examples, an elongated block that extends along the length of the receiver extension tube 206, as depicted. Chamfered faces 404 are disposed between a side 504 of the protrusion block 502 and inner walls 506 of the locking position 316. The chamfered faces 404 beneficially guide the locking members 312 into a proper locking position.

Figure 6A:
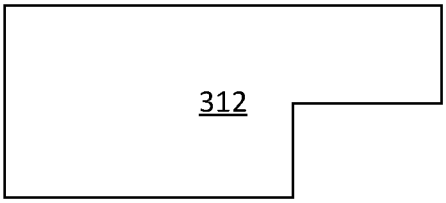
FIGS. 6*a* and 6*b* are schematic block diagrams illustrating cross-sectional views of locking members, according to examples of the subject disclosure.
Figure 6B:
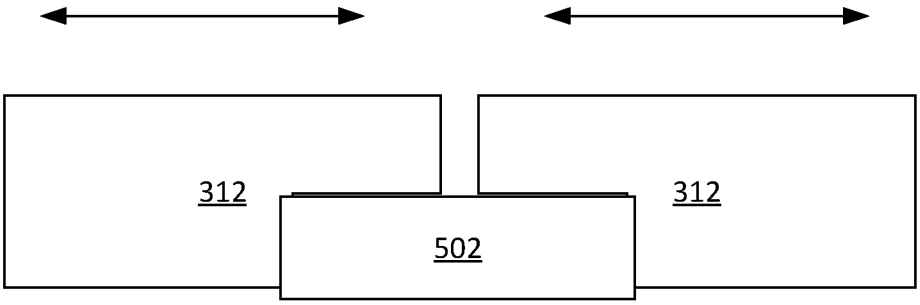

FIGS. 6*a* and 6*b* are schematic block diagrams illustrating cross-sectional views of locking members, according to examples of the subject disclosure. The locking members 312 may be formed with a cross-sectional (or side view) profile that resembles a step, as depicted. This beneficially improves the locking engagement of the locking members 312 with respect to the protrusion block 502. The locking members 312, when in a locking position, overlap the protrusion block. This allows for improved resistance to stock 102 wobble. Additionally, the step profile allows for disengagement of the protrusion block 502 with less travel of the locking members 312. Arrows depict a direction of travel of the locking members 312 towards and away from each other.

Figure 7:
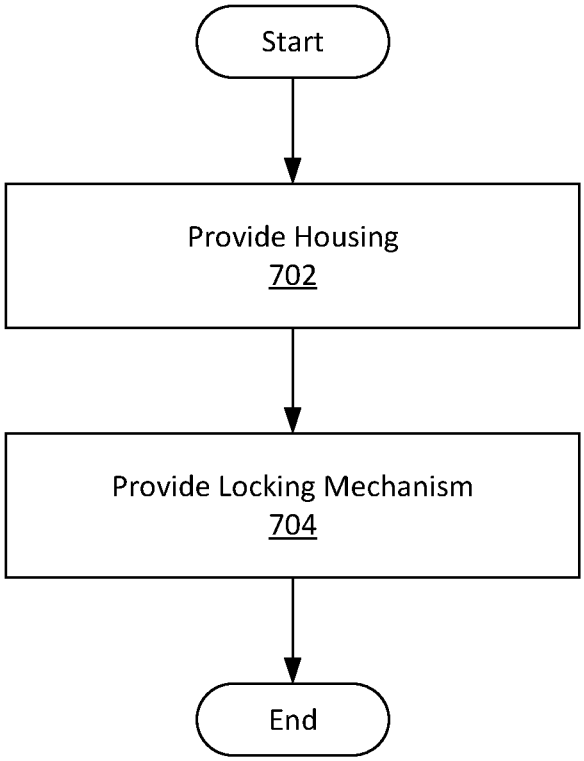
FIG. 7 is a schematic flowchart diagram illustrating an example of providing an improved positionable stock, according to examples of the subject disclosure.

FIG. 7 is a schematic flowchart diagram illustrating an example of providing an improved positionable stock, according to examples of the subject disclosure. The method, in certain examples, includes providing a housing 702. In certain examples, the housing surrounds a locking mechanism. In other examples, the locking mechanism at least partially protrudes through an external surface of the housing. In certain examples, the method also includes providing the locking mechanism. The locking mechanism, in certain examples, includes a pair of opposing locking members 312 that move towards and away from each other on a common plane, or along a common axis. The locking members are configured to move between a locked position and an unlocked position that is actuated by a lever disposed on a lateral side of the housing. To actuate the locking mechanism, in certain examples, a user squeezes both levers simultaneously to retract the locking members and allow the stock to slide lengthwise along the receiver extension tube.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A positionable stock for a rifle, comprising:

an elongated receiver extension tube coupled to the rifle;

a housing slidably coupled with the receiver extension tube, where the housing is positionable at one of a plurality of locking positions that are disposed along a length of the receiver extension tube, where the receiver extension tube defines a longitudinal axis, the housing comprising:

a pair of pivoting levers, each of the pair of pivoting levers being disposed on a lateral side of the housing, and where each of the pivoting levers is coupled to and actuates one of a pair of locking members; and where each of the pair of locking members travels along a common axis into and out of locking engagement with the receiver extension tube, and where the common axis is transverse to the longitudinal axis.

2. The positionable stock of claim 1, where the housing further comprises a first cut-out portion disposed on a first lateral side of the housing and a second cut-out portion disposed on a second lateral side of the housing opposite the first cut-out portion, and where each of the first cut-out portion and the second cut-out portion is configured to receive a finger pad of one of the pair of pivoting levers.

3. The positionable stock of claim 1, where the receiver extension tube comprises a protrusion block that extends along the length of the receiver extension tube.

4. The positionable stock of claim 3, where the plurality of locking positions comprise pairs of opposing notches formed in the protrusion block.

5. The positionable stock of claim 4, where the protrusion block further comprises a chamfered surface disposed between a side surface of the protrusion block and an inner wall of one of the notches of the pairs of opposing notches.

6. The positionable stock of claim 1, where each of the pair of locking members comprises a protrusion-block-engaging surface that has a stepped cross-sectional profile.

7. The positionable stock of claim 1, where each of the pair of pivoting levers pivots about a pivot pin coupled with the housing.

8. The positionable stock of claim 7, further comprising a spring configured to bias the locking members into a locking position.

9. The positionable stock of claim 1, where the positionable stock is adjustable to alter a length of pull of the rifle.

10. A rifle, comprising:

an elongated receiver extension tube coupled to the rifle;

a housing slidably coupled with the receiver extension tube, where the housing is positionable at one of a plurality of locking positions that are disposed along a length of the receiver extension tube, where the receiver extension tube defines a longitudinal axis, the housing comprising:

a pair of pivoting levers, each of the pair of pivoting levers being disposed on a lateral side of the housing, and where each of the pivoting levers is coupled to and actuates one of a pair of locking members; and where each of the pair of locking members travels along a common axis into and out of locking engagement with the receiver extension tube, and where the common axis is transverse to the longitudinal axis.

11. The rifle of claim 10, where the housing further comprises a first cut-out portion disposed on a first lateral side of the housing and a second cut-out portion disposed on a second lateral side of the housing opposite the first cut-out portion, and where each of the first cut-out portion and the second cut-out portion is configured to receive a finger pad of one of the pair of pivoting levers.

12. The rifle of claim 10, where the receiver extension tube comprises a protrusion block that extends along the length of the receiver extension tube.

13. The rifle of claim 12, where the plurality of locking positions comprise pairs of opposing notches formed in the protrusion block.

14. The rifle of claim 13, where the protrusion block further comprises a chamfered surface disposed between a side surface of the protrusion block and an inner wall of one of the notches of the pairs of opposing notches.

15. The rifle of claim 10, where each of the pair of locking members comprises a protrusion-block-engaging surface that has a stepped cross-sectional profile.

16. The rifle of claim 10, where each of the pair of pivoting levers pivots about a pivot pin coupled with the housing.

17. The rifle of claim 16, further comprising a spring configured to bias the locking members into a locking position.

18. The rifle of claim 10, where the housing is adjustable to alter a length of pull of the rifle.

19. A method comprising:

providing a housing that is slidably coupled to an elongated receiver extension tube, where the housing is positionable at one of a plurality of locking positions that are disposed along a length of the receiver extension tube, where the receiver extension tube defines a longitudinal axis, the housing comprising:

a pair of pivoting levers, each of the pair of pivoting levers being disposed on a lateral side of the housing, and where each of the pivoting levers is coupled to and actuates one of a pair of locking members; and where each of the pair of locking members travels along a common axis into and out of locking engagement with the receiver extension tube, and where the common axis is transverse to the longitudinal axis.

20. The method of claim 19, where the receiver extension tube comprises a protrusion block that extends along the length of the receiver extension tube.

* * * * *